US011735386B2

(12) United States Patent
Zhou

(10) Patent No.: US 11,735,386 B2
(45) Date of Patent: Aug. 22, 2023

(54) ANTI-SHORT CIRCUIT STRUCTURE OF HIGH-CAPACITY RELAY

(71) Applicant: DONGGUAN ZHONGHUI RUIDE ELECTRONICS CO., LTD, Dongguan (CN)

(72) Inventor: Kangping Zhou, Dongguan (CN)

( * ) Notice: Subject to any disclaimer, the term of this patent is extended or adjusted under 35 U.S.C. 154(b) by 324 days.

(21) Appl. No.: 17/297,985

(22) PCT Filed: Apr. 2, 2020

(86) PCT No.: PCT/CN2020/082903

§ 371 (c)(1),
(2) Date: May 27, 2021

(87) PCT Pub. No.: WO2021/022822

PCT Pub. Date: Feb. 11, 2021

(65) Prior Publication Data

US 2022/0122792 A1 Apr. 21, 2022

(30) Foreign Application Priority Data

Aug. 18, 2019 (CN) ..... 201910729337.9

(51) Int. Cl.
*H01H 50/04* (2006.01)
*H01H 47/00* (2006.01)
*H01H 53/04* (2006.01)

(52) U.S. Cl.
CPC ..... *H01H 47/002* (2013.01); *H01H 50/041* (2013.01); *H01H 53/04* (2013.01)

(58) Field of Classification Search
CPC ..... H01H 1/54; H01H 53/02; H01H 53/04; H01H 50/041

(Continued)

(56) References Cited

U.S. PATENT DOCUMENTS 3,887,888 A * 6/1975 Bayles ..... H01H 1/50 335/16
3,991,290 A * 11/1976 Bayles ..... H01H 1/54 200/250

(Continued)

FOREIGN PATENT DOCUMENTS

CN 101677044 A 3/2010
CN 109659197 A 4/2019

(Continued)

*Primary Examiner* — Alexander Talpalatski
(74) *Attorney, Agent, or Firm* — Tsz Lung Yeung

(57) ABSTRACT

An anti-short circuit structure (10) of a high-capacity relay, the structure (10) comprising a housing assembly (100) and a pushing assembly (200). The housing assembly (100) comprises two static contacts (110), a first magnetically conductive block (120), a cover body (130), a transition block (160), and a yoke plate (140). The first magnetically conductive block (120) is disposed on an inner side surface of the top part of the cover body (130). The pushing assembly (200) comprises a fixing support (210), a stop piece (220), a movable reed (230), a second magnetically conductive block (240), an elastic member (250), and a push rod (260). The fixing support (210) comprises two fixing side arms (211) and a receiving plate (212). One end of the stop piece (220) is connected to the tail end of one fixing side arm (211), and the other end of the stop piece (220) is connected to the tail end of the other fixing side arm (211). Two ends of the movable reed (230) are disposed facing the two static contacts (110) respectively, and the second magnetically conductive block (240) is disposed facing the first magnetically conductive block (120). The first magnetically conductive block (120) and the second magnetically conductive block (240) are used to form magnetic flux. In the described anti-short circuit structure (10), when a coil is excited, the positions of the first magnetically conductive block (120) and the second magnetically conductive block (Continued)

(240) do not change due to overtravel. A magnetic air gap does not increase as overtravel increases, and an increase in overtravel does not affect magnetic attraction and does not affect the anti-short circuit function of the relay.

10 Claims, 15 Drawing Sheets

(58) Field of Classification Search
USPC ..... 335/195
See application file for complete search history.

(56) References Cited

U.S. PATENT DOCUMENTS

| | | | | |
|---|---|---|---|---|
| 8,138,872 | B2 * | 3/2012 | Yoshihara | H01F 7/1615 335/185 |
| 9,059,523 | B2 * | 6/2015 | Enomoto | H01H 1/54 |
| 9,269,507 | B2 * | 2/2016 | Enomoto | H01H 1/54 |
| 10,026,577 | B2 * | 7/2018 | Hiroki | H01H 51/06 |
| 2009/0322454 | A1 * | 12/2009 | Tanaka | H01H 50/38 335/189 |
| 2014/0002215 | A1 * | 1/2014 | Ionescu | H01H 50/18 335/18 |
| 2019/0148095 | A1 * | 5/2019 | Minowa | H01H 50/42 335/185 |

FOREIGN PATENT DOCUMENTS

| | | | |
|---|---|---|---|
| CN | 110349811 | A | 10/2019 |
| CN | 210142625 | U | 3/2020 |

* cited by examiner

ANTI-SHORT CIRCUIT STRUCTURE OF HIGH-CAPACITY RELAY

BACKGROUND OF THE PRESENT INVENTION

Field of Invention

The present application relates to the field of a relay, and more specially relates to an anti-short circuit structure for a high-capacity relay.

Description of Related Arts

At present, Chinese patent CN201180035052.7 discloses a contact apparatus including a case accommodating therein fixed contacts and movable contacts and a driving unit configured to drive the movable contacts to come into contact or out of contact the fixed contacts. The contact apparatus comprises: the case; fixed terminals having the fixed contacts arranged within the case; a movable contact member having the movable contacts provided on one surface thereof so as to come into contact or out of contact with the fixed contacts; a first yoke arranged on said one surface of the movable contact member within the case, one surface of the first yoke facing an inner surface of the case and the other surface thereof facing said one surface of the movable contact member; a second yoke arranged on the other surface of the movable contact member within the case, the second yoke having one surface facing the other surface of the first yoke through the movable contact member; a contact pressure spring configured to bias the movable contact member toward the fixed contacts; a movable shaft moving integrally with the first yoke; and the drive unit configured to drive the movable shaft so that the movable contacts come into contact or out of contact with the fixed contacts, wherein on the moving direction of the movable contacts, the thickness of the first yoke on the part opposite to the movable contacts is greater than that of the second yoke. Referring to the specification and drawings of Chinese patent CN201180035052.7, it can be seen that the movable shaft moves upward through the driving unit, the movable contacts and the fixed contacts will be butted, and the contacts will be connected. When the current flows on the movable contacts, a magnetic field is generated around the movable contacts, which forms a magnetic flux through the yoke plates, and a magnetic suction is generated between the yoke plates. When the electric repulsion force is generated between the movable contacts and the fixed contacts due to the fault current, the magnetic suction between the yoke plates and the fixed contacts will play a restraining role to resist the electric repulsion force and ensure that the movable contacts and the fixed contacts are not separated, so as to realize the anti short circuit function.

However, it is necessary to produce over-stroke when the movable and fixed contacts contact in the relay. Therefore, after the movable contact is butted with the fixed contact, the movable shaft will continue to move upward, and the contact pressure spring will be further compressed, that is, the compression elastic deformation will occur to produce over-stroke. At this time, one of the yoke plates will move away from the other, and there will be a magnetic air gap between the two yoke plates, that is, there will be a gap between one yoke plate and the other yoke plate. The larger the magnetic air gap between the yoke plates, the greater the magnetic resistance in the magnetic circuit. That is to say, the magnetic suction between the two yoke plates will decrease with the increase of the magnetic air gap. In the field of relay technology, over-stroke is a very important parameter. For example, when the movable and fixed contacts are bonded, a larger over-stroke can provide a greater breaking force, which can effectively tear off the bond. According to the contact apparatus disclosed in Chinese patent CN201180035052.7, the larger the over-stroke between the movable contact and the fixed contact, the larger the magnetic air gap between the two yoke plates, so as to reduce the magnetic suction. The anti-short circuit function is affected, and there is a contradiction between the over-stroke and the magnetic air gap.

SUMMARY OF THE PRESENT INVENTION

Based on this, it is necessary to provide an anti-short circuit structure for a high-capacity relay to solve the technical problem that the magnetic air gap becomes larger due to the increase of over-stroke, which affects the anti-short circuit function.

An anti-short circuit structure for a high-capacity relay comprises a shell assembly and a pushing assembly. The shell assembly comprises two fixed contacts, a first magnetic conduction block, a cover body, a transition block and a yoke plate. The two fixed contacts penetrate the cover body and are connected with the cover body, the first magnetic conduction block is arranged at an inner side surface of a top of the cover body, and the cover body is connected with the yoke plate through the transition block. The pushing assembly comprises a fixing support, a stopping sheet, a movable contact spring, a second magnetic conduction block, an elastic component and a pushing rod. The fixing support comprises two fixed side arms and a bearing plate. The two fixed side arms are respectively arranged on both sides of the bearing plate. One end of the stopping sheet is connected with a tail end of one of the fixed side arms, and the other end of the stopping sheet is connected with a tail end of the other fixed side arm. The elastic component is arranged between the two fixed side arms, one end of the elastic component is connected with the bearing plate, and the other end of the elastic component is connected with the second magnetic conduction block. One side of the movable contact spring is connected with the second magnetic conduction block, and the other side of the movable contact spring is butted with the stopping sheet. One end of the pushing rod is connected with one side of the bearing plate facing away from the fixed side arm. The cover body, the transition block and the yoke plate jointly form a receiving cavity, the first magnetic conduction block, the fixing support, the stopping sheet, the movable contact spring, the second magnetic conduction block and the elastic component are all received in the receiving cavity. The pushing rod penetrates the yoke plate and is movably connected with yoke plate. Two ends of the movable contact spring are respectively arranged towards the two fixed contacts, and the second magnetic conduction block is arranged towards the first magnetic conduction block. The first magnetic conduction block and the second magnetic conduction block are used for forming magnetic flux.

In one embodiment, the first magnetic conduction block is a strip-shaped structure, the second magnetic conduction block is a U-shaped structure, side walls of the second magnetic conduction block are wrapped around two sides of the movable contact spring and the stopping sheet, end faces of two ends of the second magnetic conduction block are respectively arranged towards two ends of the first magnetic conduction block.

In one embodiment, the shell assembly further comprises an insulating support which is an inverted U-shaped structure and is arranged in contact with an inner wall of the cover body, both of the two fixed contacts are penetrated through the insulating support, the insulating support is provided with a mounting groove, the first magnetic conduction block is accommodated in the mounting groove and connected with the insulating support.

In one embodiment, the first magnetic conduction block is bonded with the insulating support.

In one embodiment, two side walls of the insulating support are provided with arc extinguishing windows.

In one embodiment, the second magnetic conduction block is a strip-shaped structure, the first magnetic conduction block is a U-shaped structure, end faces of two ends of the first magnetic conduction block are respectively arranged towards two ends of the second magnetic conduction block.

In one embodiment, the movable contact spring is a strip-shaped sheet structure which is provided with at least two second magnetic conduction blocks and two first magnetic conduction blocks; each of the second magnetic conduction blocks is arranged in a line-shaped arrangement from one long side of the movable contact spring to the other long side of the movable contact spring, each of the second magnetic conduction blocks is arranged towards one of the first magnetic conduction blocks, each of the second magnetic conduction blocks is used to form an independent magnetic flux with each of the first magnetic conduction blocks.

In one embodiment, the movable contact spring is a strip-shaped sheet structure which is provided with at least two second magnetic conduction blocks, each of the second magnetic conduction blocks is arranged in a line-shaped arrangement from one short side of the movable contact spring to the other short side of the movable contact spring, each of the second magnetic conduction blocks is arranged towards the first magnetic conduction block, each of the second magnetic conduction blocks is used to form an independent magnetic flux with the first magnetic conduction block.

In one embodiment, the stopping sheet is provided with an arc isolating part configured for isolating arc.

In one embodiment, the first magnetic conduction block is bonded with the cover body.

With the above anti-short circuit structure for a high-capacity relay, when the coil in the relay is excited, the pushing assembly moves towards the fixed contacts, the two ends of the movable contact spring are butted with the fixed contacts respectively, at this time, the first magnetic conduction block is butted with the second magnetic conduction block. As the over-stroke continues, the elastic component continues to be compressed, and since the first magnetic conduction block is arranged at the inner side surface of the top of the cover body, the position relationship between the first magnetic conduction block and the second magnetic conduction block is not changed as the over-stroke continues. That is to say, the magnetic air gap between the first magnetic conduction block and the second magnetic conduction block is not changed, the magnetic air gap between the first magnetic conduction block and second magnetic conduction block is not widened along with the increase of the over-stroke; the increase of the over-stroke does not influence the magnetic attraction force between the first magnetic conduction block and the second magnetic conduction block, and the anti-short circuit function of the relay, thereby solving the contradiction between the over-stroke and the magnetic air gap.

DETAILED DESCRIPTION OF THE PREFERRED EMBODIMENT

Figure 1:
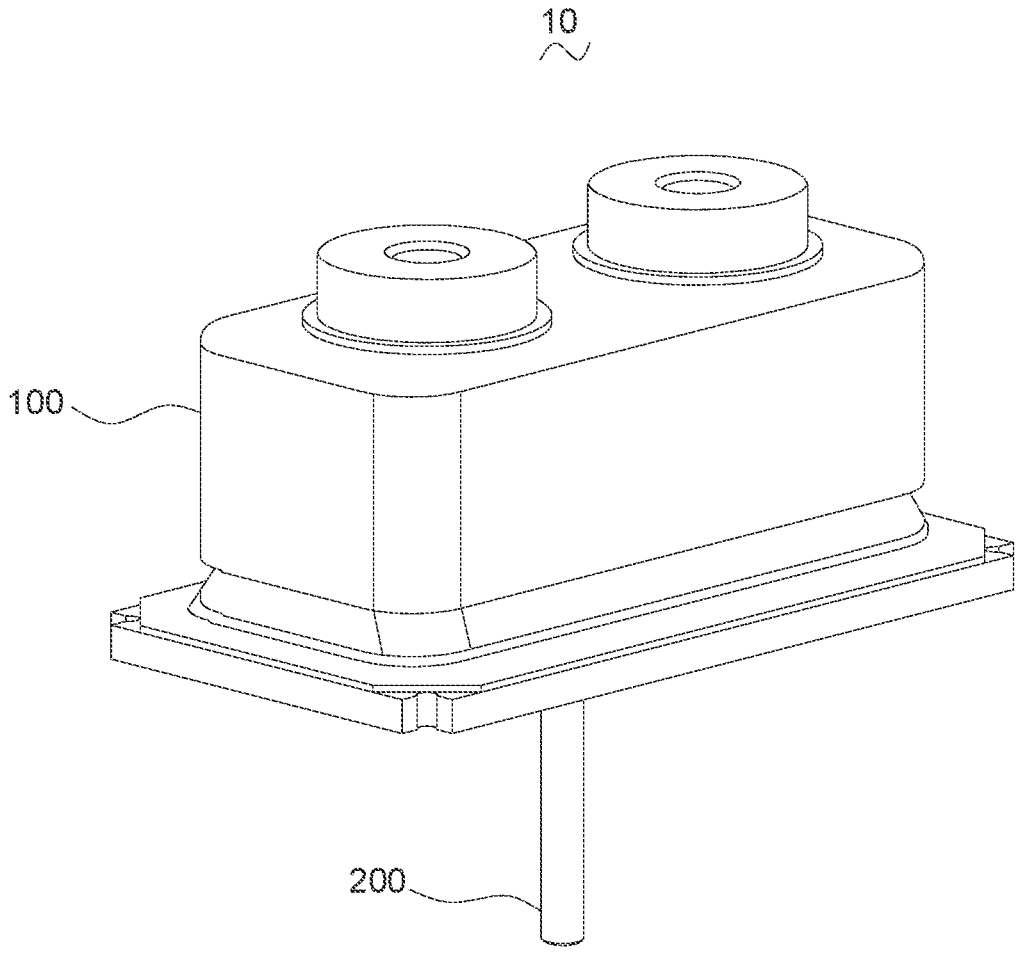
FIG. 1 is a structural diagram of the anti-short circuit structure for a high-capacity relay in one embodiment.
Figure 2:
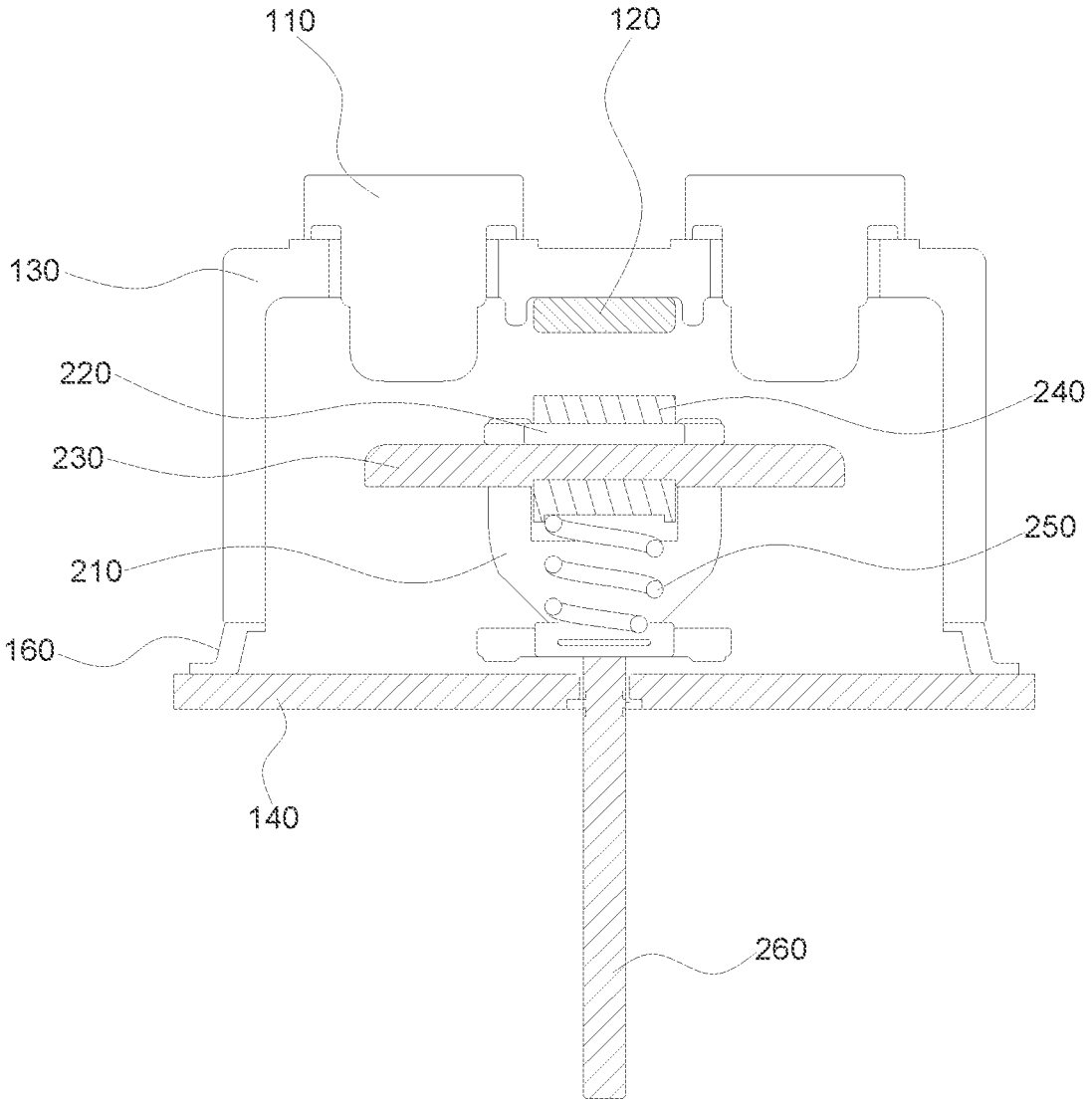
FIG. 2 is a sectional structural diagram of the anti-short circuit structure for a high-capacity relay in one embodiment.
Figure 3:
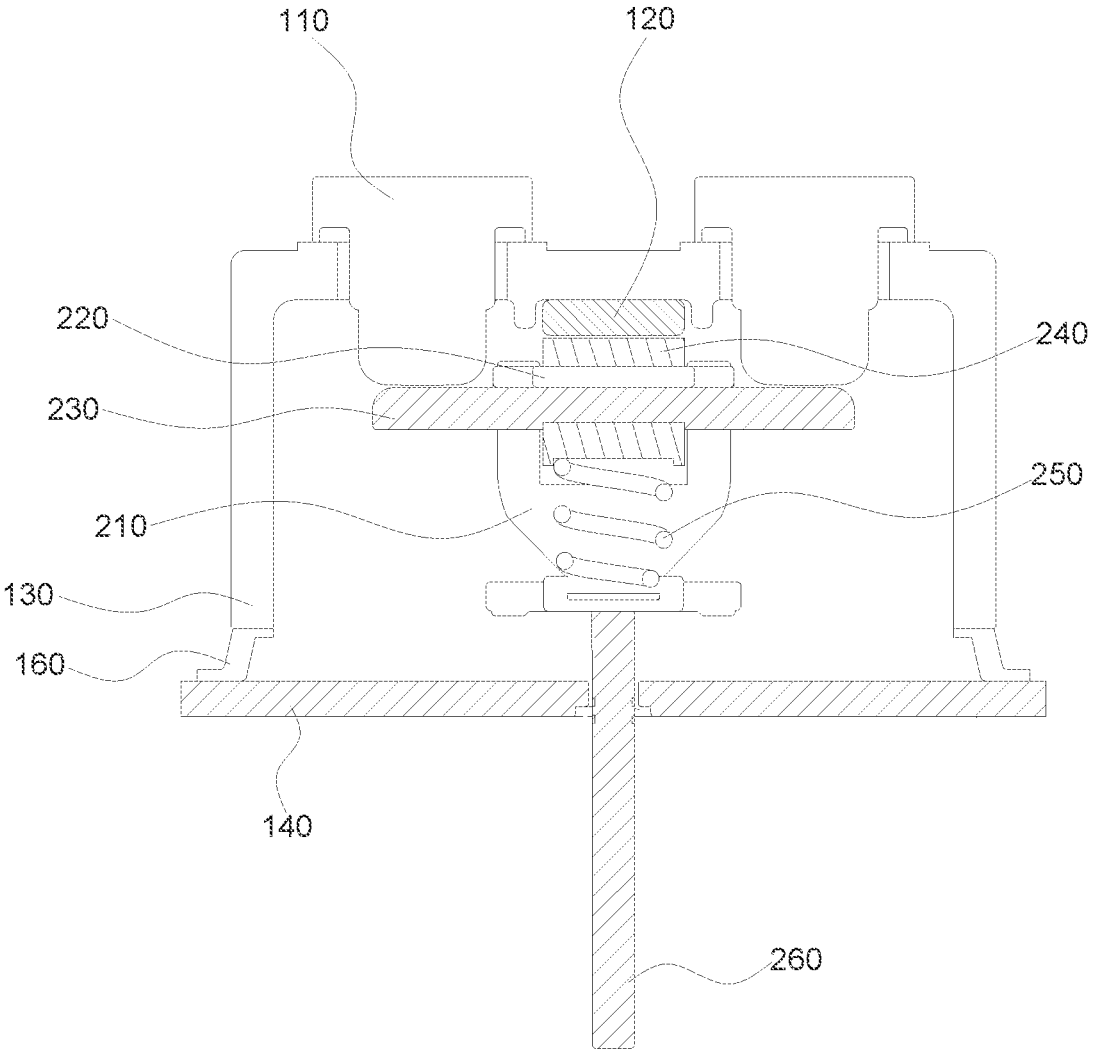
FIG. 3 is another state diagram of the anti-short circuit structure for a high-capacity relay in the embodiment shown in FIG. 2.
Figure 4:
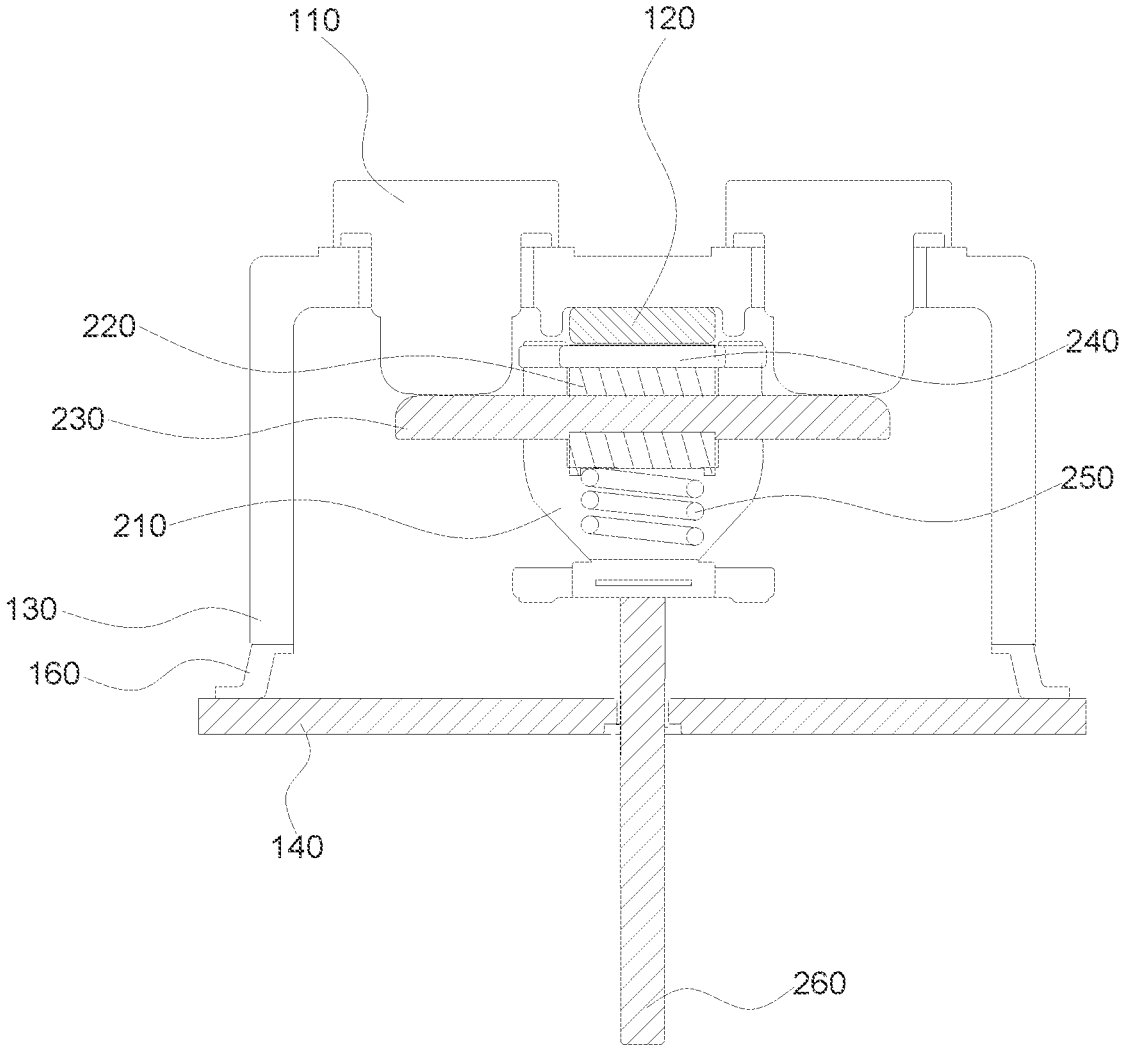
FIG. 4 is another state diagram of the anti-short circuit structure for a high-capacity relay in the embodiment shown in FIG. 3.
Figure 5:
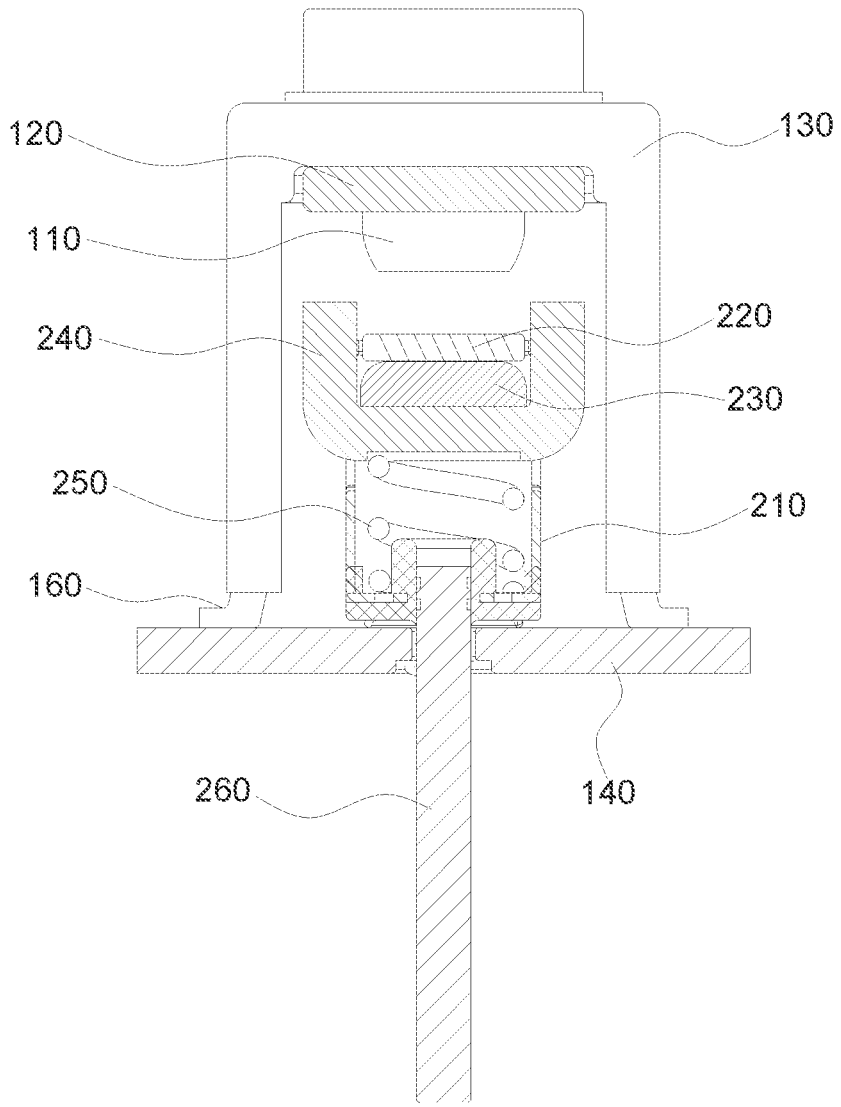
FIG. 5 is another sectional structural diagram of the anti-short circuit structure for a high-capacity relay in one embodiment.
Figure 6:
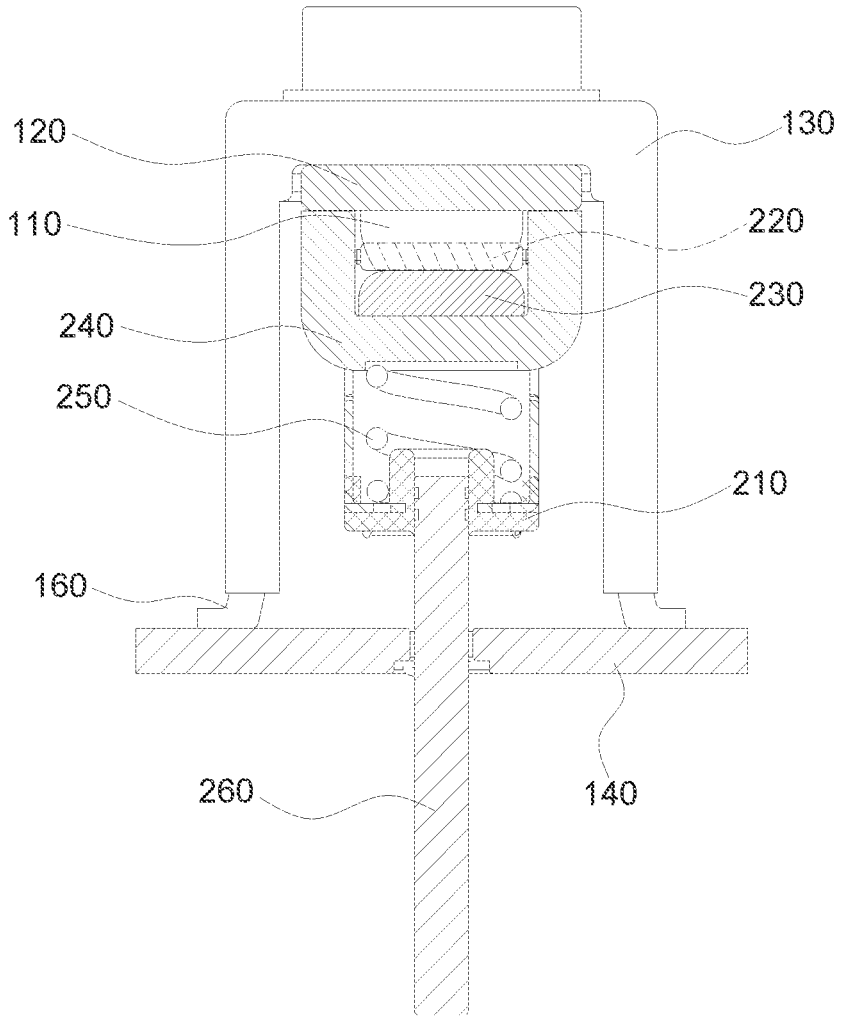
FIG. 6 is another state diagram of the anti-short circuit structure for a high-capacity relay in the embodiment shown in FIG. 5.
Figure 7:
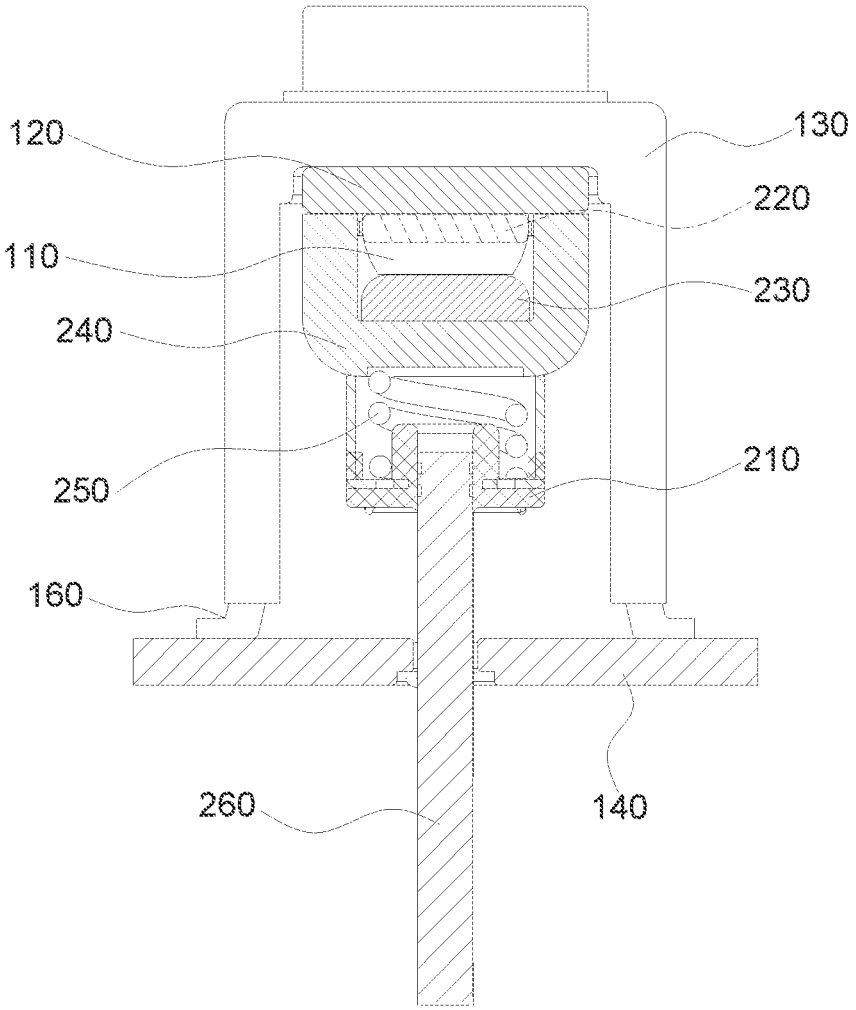
FIG. 7 is another state diagram of the anti-short circuit structure for a high-capacity relay in the embodiment shown in FIG. 6.
Figure 8:
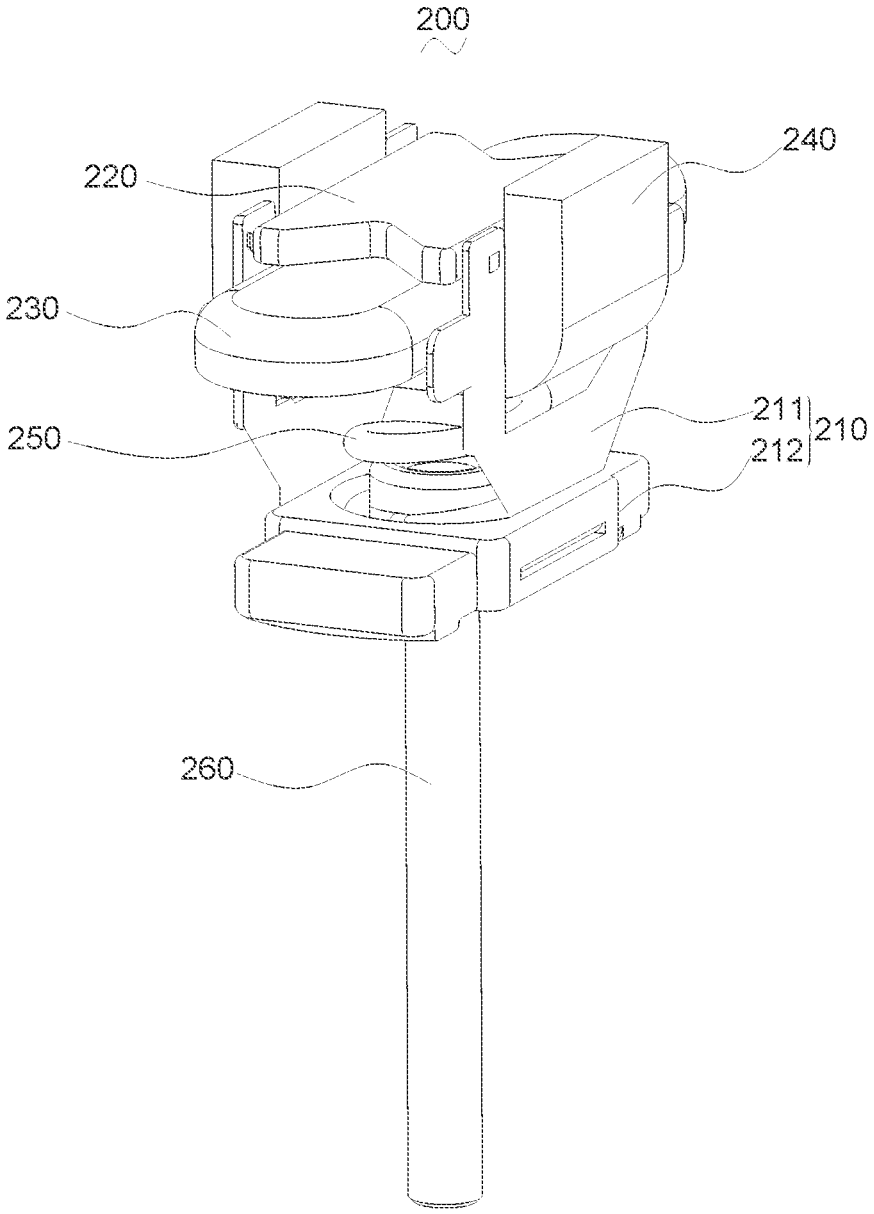
FIG. 8 is a structural diagram of the pushing assembly of the anti-short circuit structure for a high-capacity relay in one embodiment.
Figure 9:
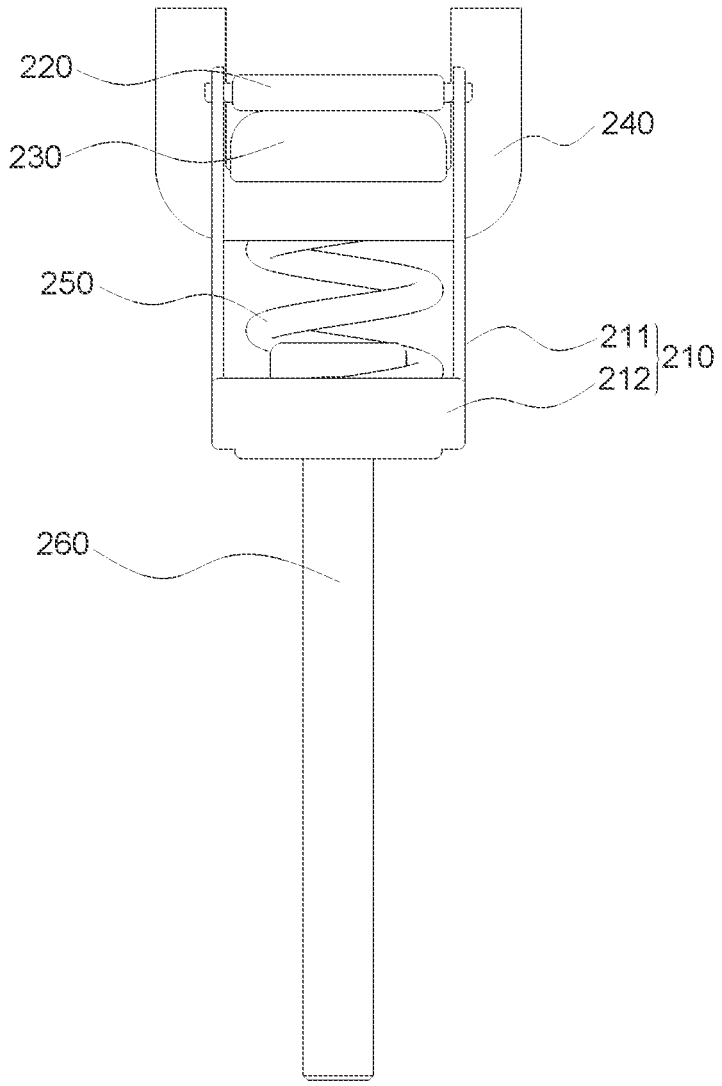
FIG. 9 is another perspective diagram of the anti-short circuit structure for a high-capacity relay in the embodiment shown in FIG. 8.
Figure 10:
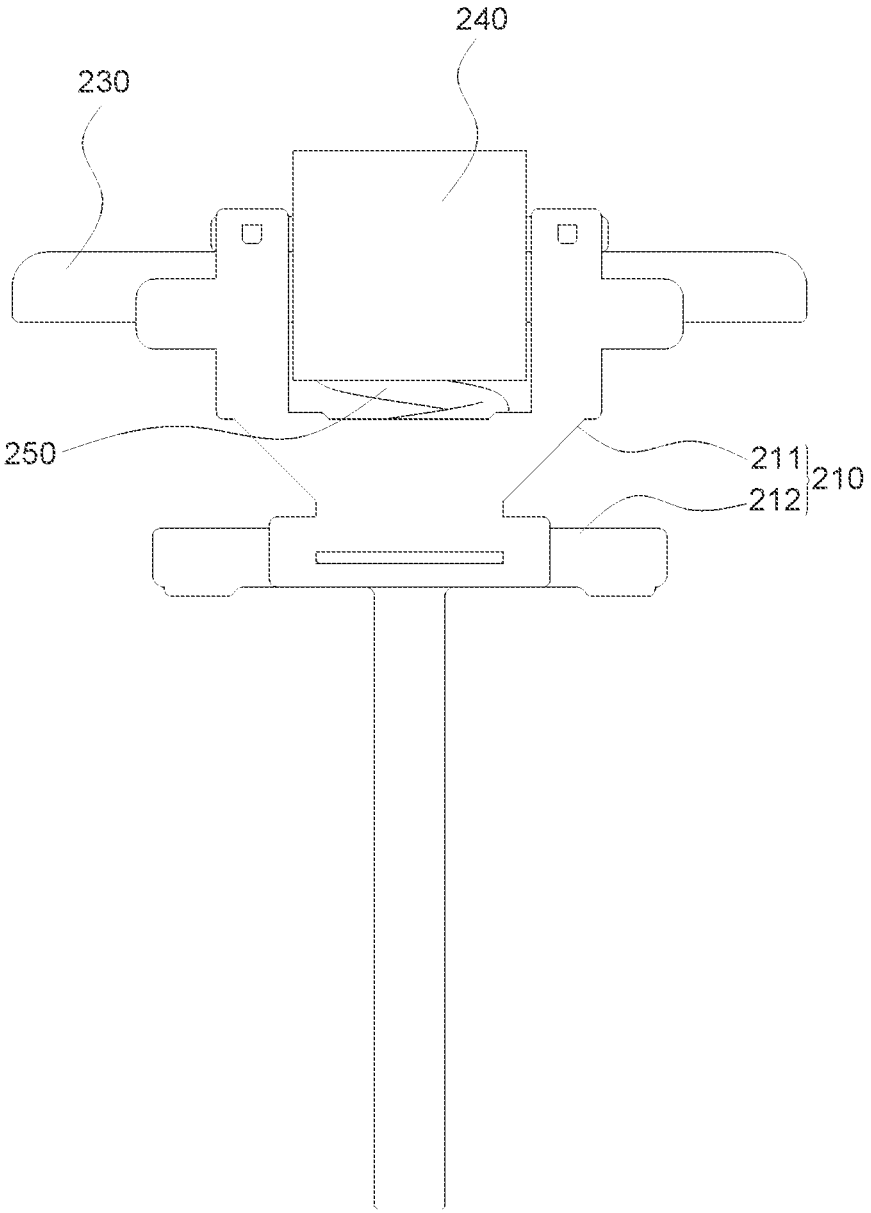
FIG. 10 is another perspective diagram of the anti-short circuit structure for a high-capacity relay in the embodiment shown in FIG. 8.
Figure 11:
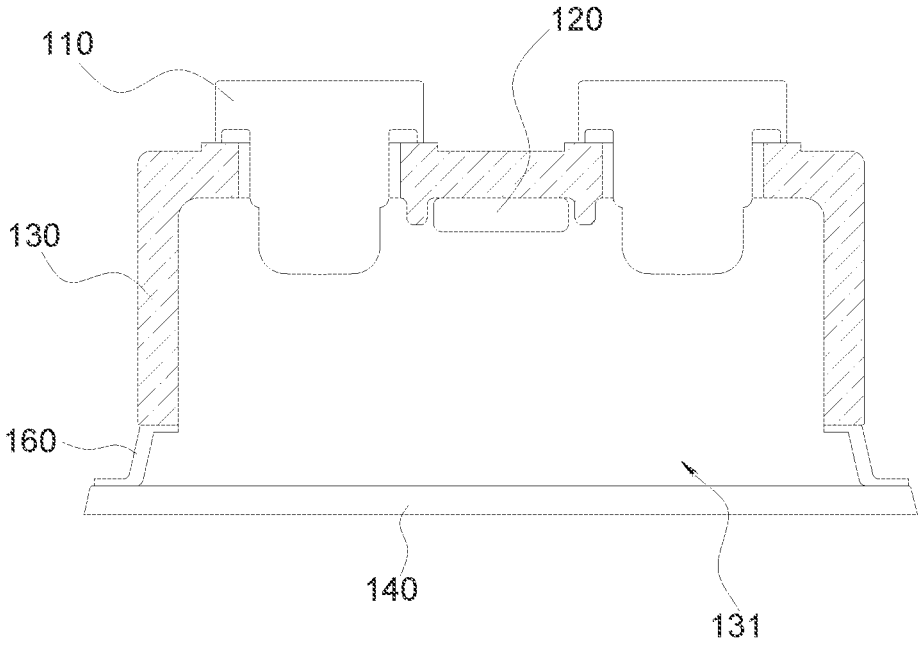
FIG. 11 is a structural diagram of the shell assembly of the anti-short circuit structure for a high-capacity relay in one embodiment.

In order to make the above purposes, features and advantages of the application more obvious and easy to understand, the specific implementation mode of the application is described in detail in combination with the attached drawings. Many specific details are described in the following description to facilitate a full understanding of the application. However, the application can be implemented in many other ways different from those described here, and those skilled in the art can make similar improvements without violating the connotation of the application. Therefore, the application is not limited by the specific embodiments disclosed below.

In the description of the application, it needs to be understood that the orientation or position relationship indicated by the terms "center", "longitudinal", "transverse", "length", "width", "thickness", "up", "down", "front", "back", "left", "right", "vertical", "horizontal", "top", "bottom", "inside", "outside", "clockwise", "counterclockwise", "axial", "radial" and "circumferential" and so on is based on the orientation or position relationship shown in the figure, which is only for the convenience of describing the application and simplifying the description, rather than indicating or implying that the device or element must have a specific orientation and be constructed and operated in a specific orientation. Therefore, it cannot be understood as a limitation of the application.

In addition, the terms "first" and "second" are used for descriptive purposes only and cannot be understood as indicating or implying relative importance or implicitly indicating the number of technical features indicated. Thus, the features defined as "first" and "second" may explicitly or implicitly include at least one of the features. In the description of the application, "multiple" means at least two, such as two, three, etc., unless otherwise specified.

In the application, unless otherwise specified and limited, the terms "installing", "connection", "connected", "fixed" and other terms should be understood in a broad sense. For example, they can be fixedly connected, movably connected or integrally connected; they can be mechanically connected or electrically connected; they can be directly connected or indirectly connected through intermediate medium; they can be the internal connection of two components or the interaction between two components, unless otherwise specified. For those skilled in the art, the specific meaning of the above terms in the application can be understood according to the specific situation.

In the application, unless otherwise specified and limited, the first feature "up" or "down" of the second feature can be that the first and second features are in direct contact, or the first and second features are in indirect contact through an intermediate medium. Moreover, the first feature is "above", "on" and "at" the second feature, but the first feature is directly above or obliquely above the second feature, or only indicates that the horizontal height of the first feature is higher than that of the second feature. The first feature "below", "lower" and "under" of the second feature can be that the first feature is directly below or obliquely below the second feature, or only that the horizontal height of the first feature is less than that of the second feature.

It should be noted that when a component is said to be "fixed" or "arranged" to another component, it can be directly on another component or there can be a component in the middle. When a component is considered to be "connected" to another component, it can be directly connected to another component or there may be a component between them. The terms "vertical", "horizontal", "up", "down", "left", "right" and similar expressions used in this application are only for the purpose of illustration, and do not mean that they are the only mode of implementation.

Please referring to FIG. 1 to FIG. 11, the present application provides an anti-short circuit structure for a high-capacity relay 10. The anti-short circuit structure for a high-capacity relay 10 comprises a shell assembly 100 and a pushing assembly 200. The shell assembly 100 comprises two fixed contacts 110, a first magnetic conduction block 120, a cover body 130, a transition block 160 and a yoke plate 140. The two fixed contacts 110 penetrate the cover body 130 and are connected with the cover body 130. The first magnetic conduction block 120 is arranged at an inner side surface of a top of the cover body 130, and the cover body 130 is connected with the yoke plate 140 through the transition block 160. The pushing assembly 200 comprises a fixing support 210, a stopping sheet 220, a movable contact spring 230, a second magnetic conduction block 240, an elastic component 250 and a pushing rod 260. The fixing support 210 comprises two fixed side arms 211 and a bearing plate 212. The two fixed side arm 211 are respectively arranged on both sides of the bearing plate 212. One end of the stopping sheet 220 is connected with a tail end of the fixed side arm 211, and the other end of the stopping sheet 220 is connected with a tail end of the other fixed side arm 211. The elastic component 250 is arranged between the two fixed side arms 211, one end of the elastic component 250 is connected with the bearing plate 212, and the other end of the elastic component 250 is connected with the second magnetic conduction block 240. One side of the movable contact spring 230 is connected with the second magnetic conduction block 240, and the other side of the movable contact spring 230 is butted with the stopping sheet 220. One end of the pushing rod 260 is connected with one side of the bearing plate 212 facing away from the fixed side arm 211. A receiving cavity 131 for receiving the first magnetic conduction block 120, the fixing support 210, the stopping sheet 220, the movable contact spring 230, the second magnetic conduction block 240 and the elastic component 250 is jointly formed by the cover body 130 and the yoke plate 140. The pushing rod 260 penetrates the yoke plate 140 and is movably connected with the yoke plate 140. The two ends of the movable contact spring 230 are respectively arranged towards the fixed contacts 110, and the second magnetic conduction block 240 is arranged towards the first magnetic conduction block 120. The first magnetic conduction block 120 and the second magnetic conduction block 240 are used for forming magnetic flux.

With the above anti-short circuit structure for a high-capacity relay 10, when the coil in the relay is excited, the pushing assembly 200 moves towards the fixed contacts 110, the two ends of the movable contact spring 230 are butted with the fixed contacts 110. At this time, the first magnetic conduction block 120 is butted with the second magnetic conduction block 240. As the over-stroke continues, the elastic component 250 continues to be compressed, and since the first magnetic conduction block 120 is arranged at the inner side surface of the top of the cover body 130, the position relationship between the first magnetic conduction block 120 and the second magnetic conduction block 240 is not changed as the over-stroke continues. That is to say, the magnetic air gap between the first magnetic conduction block 120 and the second magnetic conduction block 240 is not changed, the magnetic air gap between the first magnetic conduction block 120 and second magnetic conduction block 240 is not widened along with the increase of the over-stroke; the increase of the over-stroke does not influence the magnetic attraction force between the first magnetic conduction block 120 and the second magnetic conduction block 240, and the anti-short circuit function of the relay, thereby solving the contradiction between the over-stroke and the magnetic air gap.

The shell assembly 100 serves as a fixed part in the relay, that is, when the coil in the relay is excited, the shell assembly 100 will not move. Two of the fixed contacts 110 are used to access the external circuit. When the two fixed contacts 110 is butted with the movable contact spring 230, the external circuit is conductive. The cover body 130 and the yoke plate 140 are used to package the pushing assembly 200. In this embodiment, the cover body 130 is a cover in a rectangular structure, and further, the cover body 130 is a ceramic cover. Ceramic cover has the characteristics of strong insulation ability, high strength, high temperature resistance and aging resistance. The transition block 160 is used to realize the connection between the cover body 130 and the yoke plate 140. The transition block 160 is made of Kovar alloy, copper and copper alloy or stainless steel. The setting of the transition block 160 is a common technical means in the technical field to connect the cover 130 and the yoke plate 140, and is the only way to realize the connection between the cover 130 and the yoke plate 140 and ensure the air tightness. The specific connection structure and principle of the transition block can refer to the existing technology, which will not be described here. The structural shapes of the cover body 130, the transition block 160 and the yoke plate 140 can be set according to the actual product requirements. A receiving cavity 131 is jointly formed by the cover body 130, the transition block 160 and the yoke plate 140. At the same time, the receiving cavity 131 is equivalent to an arc extinguishing chamber, which provides the receiving space for the first magnetic conduction block 120, the fixing support 210, the stopping sheet 220, the movable contact spring 230, the second magnetic conduction block 240 and the elastic component 250, and ensures the safety of the relay structure. Furthermore, in one embodiment, the receiving cavity 131 is sealed with a gas with strong arc cooling ability. For example, mixed gas mainly composed of hydrogen. In this way, the arc extinguishing performance of the anti-short circuit structure for a high-capacity relay is enhanced. The first magnetic conduction block 120 is used to form a magnetic flux with the magnetic conduction block 240. When the two fixed contacts 110 are butted with the movable contact spring 230, the circuit is connected, and the current flows through the movable contact spring 230. According to the ampere rule, that is, the right-hand spiral rule, the first magnetic conduction block 120 and the second magnetic conduction block 240 form a magnetic flux, and a magnetic attraction force will be generated between the first magnetic conduction block 120 and the second magnetic conduction block 240, that is, the first magnetic conduction block 120 and the second magnetic conduction block 240 are close to each other.

The pushing assembly 200 serves as an action component of the relay, that is, when the coil in the relay is excited, the pushing assembly 200 will move. That is, the entire pushing assembly 200 will move toward the fixed contact 110. The fixing support 210 is used to carry the elastic component 250, the second magnetic conduction block 240, the movable contact spring 230 and the stopping sheet 220. In this embodiment, the fixed side arm 211 is in a rectangular plate-type structure, and the bearing plate 212 is in a rectangular plate-type structure. In this way, the fixing support 210 composed of two fixed side arms 211 and the bearing plate 212 is stronger. The bearing plate 212 plays a role of receiving the elastic component 250, and the two fixed side arms 211 play a role of limiting the elastic component 250, so as to prevent the elastic component 250 from tilting to the outside to facilitate assembly.

In order to strengthen the connection relationship between the two fixed side arms 211 and the bearing plate 212, in one embodiment, the two fixed side arms 211 and the bearing plate 212 are integrally formed. In this way, the connection between the two fixed side arms 211 and the bearing plate 212 is firm, and the impact resistance of the fixing support 210 is improved. In this way, the strength of the fixing support 210 is improved.

The pushing rod 260 is a force bearing part, and the pushing rod 260 is in a cylindrical structure. After the coil is excited, the electromagnetic force acts on the pushing rod 260, and the pushing rod 260 will push the fixing support 210 to move, so that the whole pushing assembly 200 moves towards the fixed contacts 110.

The elastic component 250 is used to provide an elastic force. When both ends of the movable contact spring 230 contact the two fixed contacts 110, the elastic force of the elastic component 250 acts on the movable contact spring 230 to maintain the contact relationship between the movable contact spring 230 and the fixed contacts 110. In this embodiment, the elastic component 250 is a compression spring. The movable contact spring is used for conducting the circuit. When the relay is connected to the external circuit and the two fixed contacts 110 contact the two ends of the movable contact spring 230, the external circuit is connected and the current flows through the movable contact spring 230. The stopping sheet 220 is used to further limit the elastic component 250, the second magnetic conduction block 240 and the movable contact spring 230, so as to stabilize the structure of the pushing assembly 200. One end of the stopping sheet 220 is connected with the tail end of one of the fixed side arms 211, and the other end of the stopping sheet 220 is connected with the tail end of another fixed side arm 211. The elastic component 250, the second magnetic conduction block 240 and the movable contact spring 230 are arranged between the fixing support 210 and the stopping sheet 220, and when the coil of the relay is not excited, under the elastic action of the elastic component 250, the movable contact spring 230 is butted with the stopping sheet 220. In this way, the movement of the movable contact spring 230 under the elastic action of the elastic component 250 is limited, hereby ensuring the structural stability of the pushing assembly 200. The second magnetic conduction block 240 is used to form a magnetic flux with the first magnetic conduction block 120. Since the first magnetic conduction block 120 is fixed on the cover body 130, and the second magnetic conduction block 240 is a moving part, under the action of the magnetic attraction force, the second magnetic conduction block 240 moves close to the first magnetic conduction block 120.

It should be noted that when large current flows through the two fixed contacts 110 and the movable contact spring 230, for example, the current of 6000*a*, due to the current contraction, the fixed contacts 110 and the movable contact spring 230 will generate electric repulsion at the joint of them, and the electric repulsion will push the movable contact spring 230 away from the fixed contacts 110. When the electric repulsion force is greater than the elastic force provided by the elastic component 250, the movable contact spring 230 will separate from the two fixed contacts 110. At this time, a severe arc is generated between the movable contact spring 230 and the fixed contacts 110, which may easily cause the relay to be burned. The magnetic attraction force between the first magnetic conduction block 120 and the second magnetic conduction block 240 will play a role in resisting the electrodynamic repulsion, thereby inhibiting the separation of the movable contact spring 230 and the fixed contacts 110, so as to achieve the effect of anti short circuit. In particular, when the fixed contacts 110 is butted with the movable contact spring 230, a current flows through the movable contact spring 230. That is, at this time, a magnetic flux is formed between the first magnetic conduction block 120 and the second magnetic conduction block 240, a magnetic attraction force is generated between the first magnetic conduction block 120 and the second magnetic conduction block 240. In the technical field, when the magnetic flux is generated between the first magnetic conduction block 120 and the second magnetic conduction block 240, the distance between the first magnetic conduction block 120 and the second magnetic conduction block 240 is called as the magnetic air gap. The magnetic air gap affects the magnetic resistance of the magnetic flux. The larger the magnetic air gap is, the larger the magnetic resistance is, and the smaller the magnetic attraction force between the first magnetic conduction block 120 and the second magnetic conduction block 240 is. If the magnetic attraction force is too small, it can not resist the effect of electric repulsion, and it is difficult to restrain the separation between the movable contact spring 230 and the fixed contacts 110, thus weakening the effect of anti-short circuit.

In the field of relay technology, over-stroke is a very important parameter. When the movable contact spring 230 contacts with the two fixed contacts 110, the pushing assembly 200 will not stop immediately, the whole pushing assembly 200 will continue to move, and the elastic component 250 will be further compressed. Because when the movable contact spring 230 contacts with the two fixed contacts 110, the two fixed contacts 110 limit the continuous movement of the movable contact spring 230. At this time, the movable contact spring 230 and the second magnetic conduction block 240 will not move, the fixing support 210, the stopping sheet 220 and the pushing rod 260 will continue to move, and the elastic component 250 will continue to be compressed to a certain extent. Finally, the whole pushing assembly 200 will stop moving. For the concept of over-stroke, it can be understood that the deformation degree of the elastic component 250 is the amplitude of the over-stroke during the whole process from the moment when the movable contact spring 230 just contacts with the fixed contacts 110 until the whole pushing assembly 200 stops moving.

Please refer to FIG. 2 to FIG. 7 again. The specific action process of the anti-short circuit structure for a high-capacity relay is as follows: when the coil is excited, the pushing rod 260 pushes the fixing support 210 to move towards the fixed contacts 110, and the stopping sheet 220, the movable contact spring 230, the second magnetic conduction block 240 and the elastic component 250 will move with the fixing support 210. When the movable contact spring 230 is butted with the two fixed contacts 110, a current flows through the movable contact spring 230, magnetic flux is generated between the first magnetic conduction block 120 and the second magnetic conduction block 240, and a magnetic attraction force is formed between the first magnetic conduction block 120 and the second magnetic conduction block 240. As the over-stroke continues, the movable contact spring 230 and the second magnetic conduction block 240 will not move, and the fixing support 210, the stopping sheet 220 and the pushing rod 260 will continue to move, and the magnetic air gap between the first magnetic conduction block 120 and the second magnetic conduction block 240 will not be changed. In this way, the continuation of the over-stroke does not change the size of the magnetic air gap, that is, the anti-short circuit function of the anti-short circuit structure for a high-capacity relay is not affected by the over-stroke, which solves the contradiction between the over-stroke and the magnetic air gap in the prior art.

In one embodiment, in order to maximize the magnetic attraction force, when the movable contact spring 230 is butted with the two fixed contacts 110, the magnetic air gap between the first magnetic conduction block 120 and the second magnetic conduction block 240 is zero. In this way, the magnetic resistance of the magnetic flux formed by the first magnetic conduction block 120 and the second magnetic conduction block 240 is the smallest, and the magnetic attraction force between the first magnetic conduction block 120 and the second magnetic conduction block 240 is the largest. In this way, the maximum effect of magnetic attraction is realized, and the anti short circuit performance of the anti-short circuit structure for a high-capacity relay is improved. Because this embodiment has extremely high requirements for the precision of the production mold, that is to say, it has extremely high requirements for the precision of the parts in the relay. Once the precision does not meet the requirements, it is easy to occur that the movable contact spring 230 can not be butted with the fixed contacts 110. That is to say, the first magnetic conduction block 120 is easy to be butted with the second magnetic conduction block 240, thus limiting the movement of the movable contact spring 230, resulting in that the movable contact spring 230 and the fixed contacts 110 can not be closed. In addition, when the fixed contacts 110 or the movable contact spring 230 is worn, the magnetic air gap will become smaller, and the movable contact spring 230 and the fixed contacts 110 can not be closed easily. Therefore, in order to reduce the requirements for the precision and assembly of the parts in the relay, and to improve the durability of the anti-short circuit structure for a high-capacity relay, in another embodiment, when the movable contact spring 230 is butted with the two fixed contacts 110, there is a certain magnetic air gap between the first magnetic conduction block 120 and the second magnetic conduction block 240. In this way, the case that the movable contact spring 230 and the fixed contacts 110 cannot be closed is avoided. In this way, the production difficulty of the anti-short circuit structure for a high-capacity relay is reduced, the accuracy and fault tolerance performance of the anti-short circuit structure for a high-capacity relay are improved, the wear resistance requirements of the fixed contacts 100 and the movable contact spring 230 are reduced, and the service life of the anti-short circuit structure for a high-capacity relay is extended.

Figure 15:
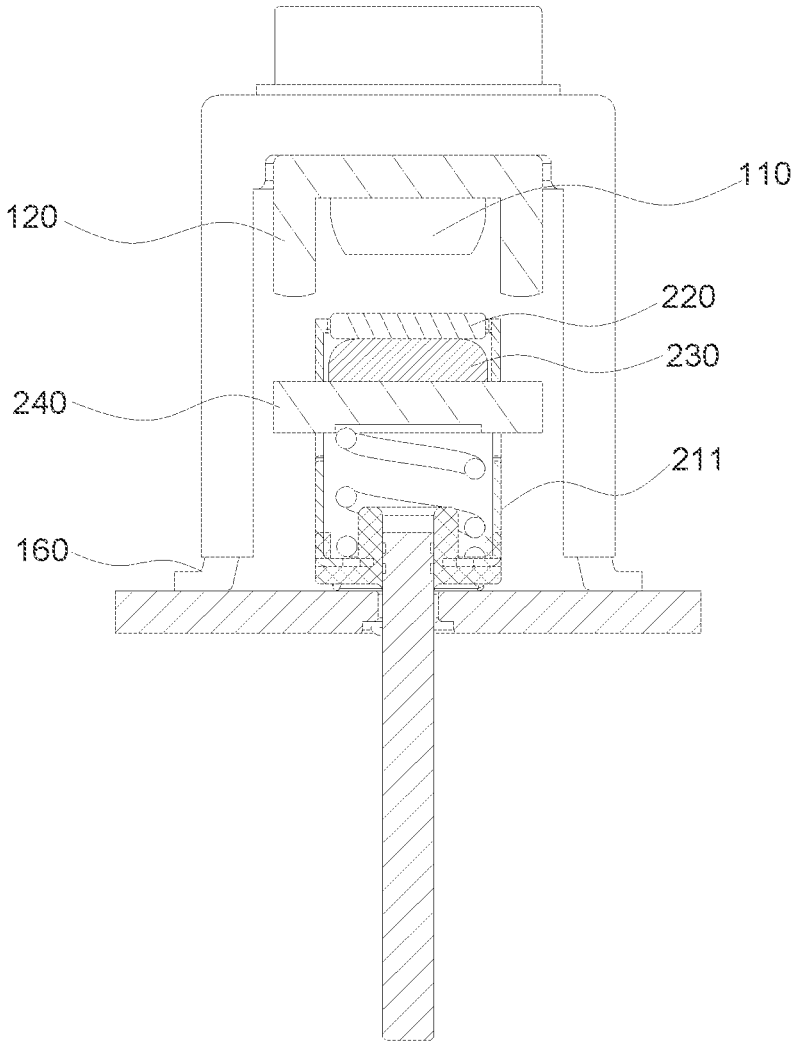
FIG. 15 is another sectional structural diagram of the anti-short circuit structure for a high-capacity relay in one embodiment.

In order to facilitate the formation of the magnetic flux between the first magnetic conduction block 120 and the second magnetic conduction block 240 in one embodiment, the first magnetic conduction block 120 is in a strip structure, the second magnetic conduction block 240 is a U-shaped structure, the two side walls of the second magnetic conduction block 240 are wrapped around the two sides of the movable contact spring 230 and the stopping sheet 220, the end faces of the two ends of the second magnetic conduction block 240 are respectively set towards the two ends of the first magnetic conduction block 120. In this way, the first magnetic conduction block 120 and the second magnetic conduction block 240 form a ring structure. In this embodiment, the fixed side arm 211 has openings, the two side walls of the second magnetic block 240 pass through the openings of the two fixed side arms 211 respectively, and the two side walls of the second magnetic conduction block 240 are movably connected with the stopping sheet 220 and the fixed side arm 211. When the relay is not in an operating state, the end faces of the two ends of the second magnetic conduction block 240 are higher than the plane of the stopping sheet 220. The distance between the end faces of the two ends of the second magnetic conduction block 240 and the plane of the stopping sheet 220, that is, the length of the side wall of the second magnetic conduction block 240 higher than the stopping sheet 220, is the maximum range of over-stroke in this embodiment. In the process of over-stroke, the stopping sheet 220 will move away from the movable contact spring 230. In this embodiment, when the relay is closed and in a stable state, there is a gap between the stopping sheet 220 and the first magnetic conduction block 120 to avoid the collision between the stopping sheet 220 and the first magnetic conduction block 120. In another embodiment, referring to FIG. 15, the second magnetic conduction block 240 is in a strip structure, the first magnetic conduction block 120 is a U-shaped structure, and the end faces of the two ends of the first magnetic conduction block 120 are respectively arranged towards the two ends of the second magnetic conduction block 240. In this way, the first magnetic conduction block 120 and the second magnetic conduction block 240 form a ring structure. Specifically, both ends of the second magnetic conduction block 240 partially pass through the openings of the two fixed side arm 211, the second magnetic conduction block 240 is movably connected with the two fixed side arms 211. When the movable contact spring 230 just contacts with the two fixed contacts 110, the distance between the top of the first magnetic conduction block 120 and the stopping sheet 220 is the maximum range of over-stoke in this embodiment. When the relay is closed and in a stable state, there is a gap between the stopping sheet 220 and the top of the first magnetic conduction block 120 to avoid the collision between the stopping sheet 220 and the first magnetic conduction block 120. In another embodiment, both the first magnetic conduction block 120 and the second magnetic conduction block 240 are U-shaped. In this way, space is reserved for the over-stroke, and the magnetic flux is formed between the first magnetic conduction block 120 and the second magnetic conduction block 240.

Figure 12:
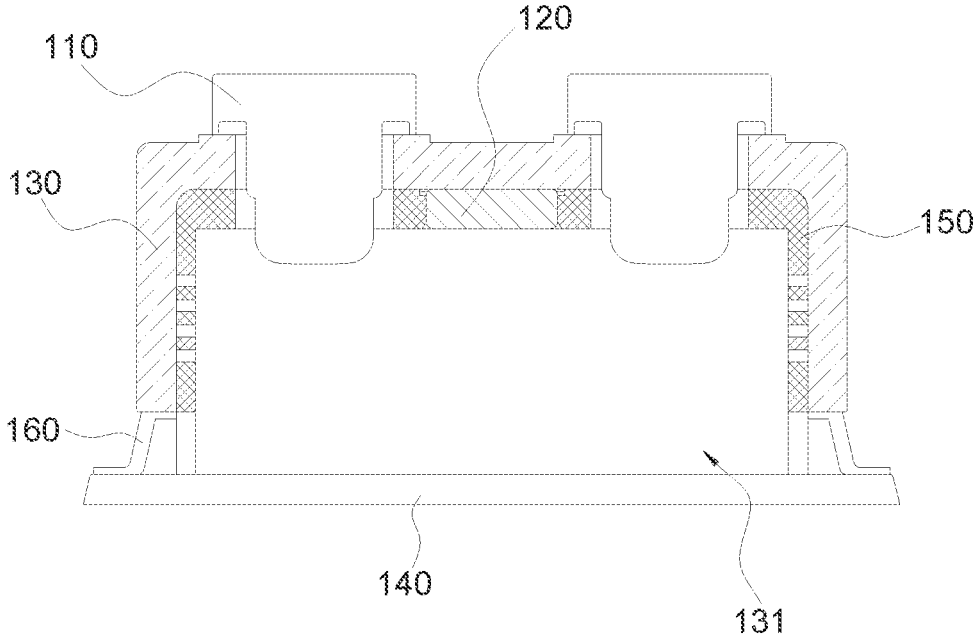
FIG. 12 is another structural diagram of the shell assembly of the anti-short circuit structure for a high-capacity relay in one embodiment.
Figure 13:
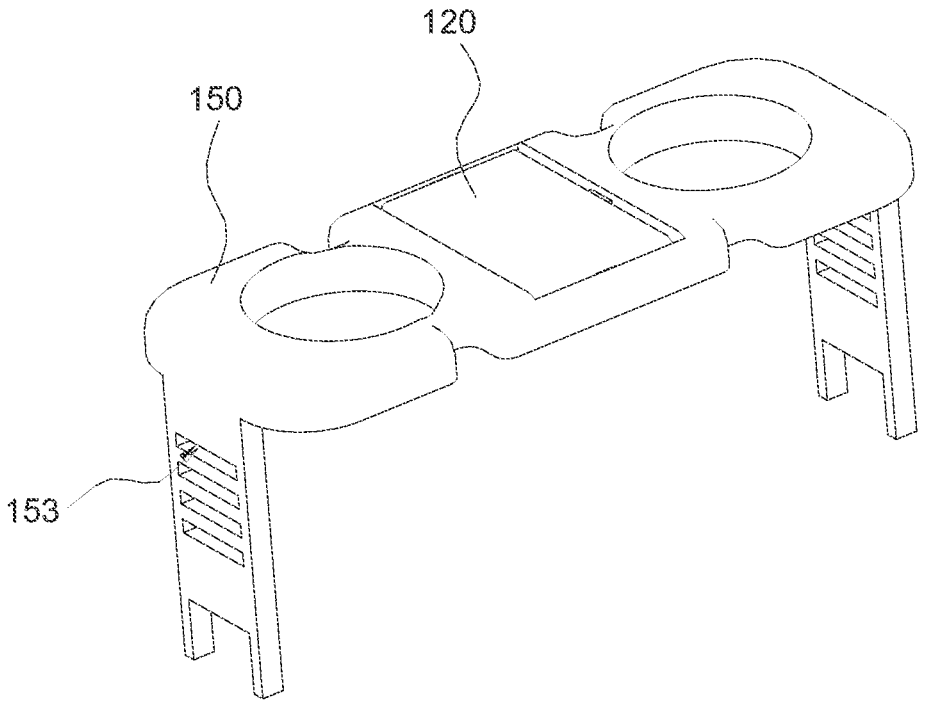
FIG. 13 is a structural diagram of the insulating support and the first magnetic conduction block of the anti-short circuit structure for a high-capacity relay in one embodiment.
Figure 14:
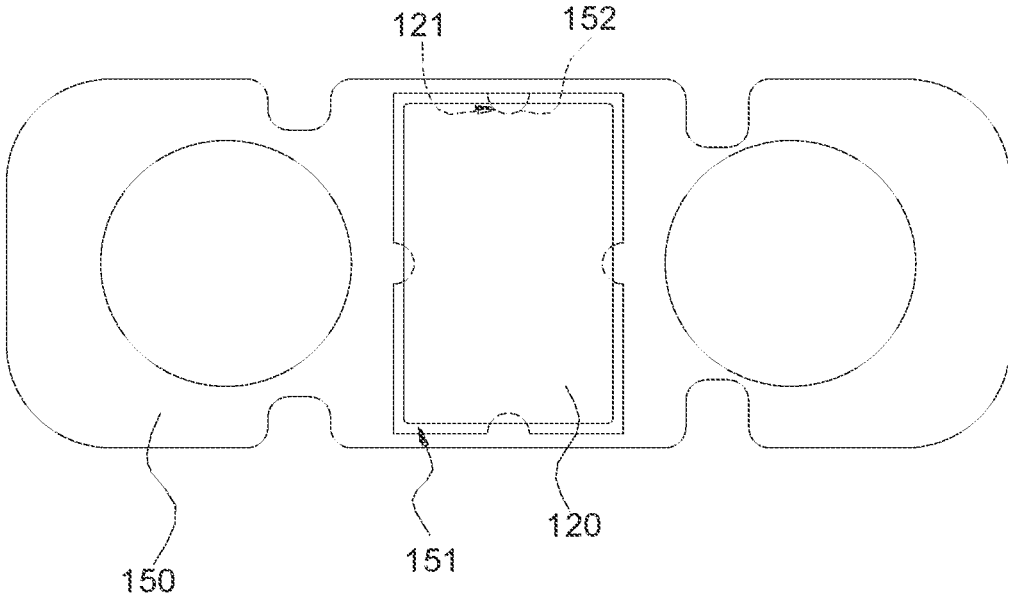
FIG. 14 is a structural diagram in another perspective of the anti-short circuit structure for a high-capacity relay in the embodiment shown in FIG. 13.

In order to fix the position of the first magnetic conduction block 120, in one embodiment, please refer to FIG. 12 to FIG. 14, the shell assembly 100 further comprises an insulating support 150 in an inverted U-shaped structure. The insulating support 150 is arranged close to the inner wall of the cover body 130. The two fixed contacts 110 penetrate the insulating support 150, and the insulating support 150 is provided with a mounting groove 151. The first magnetic conduction block 120 is receiving in the mounting groove 151 and is connected with the insulating support 150. In this way, it is convenient to install and fix the first magnetic conduction block 120, and reduce the magnetic air gap between the first magnetic conduction block 120 and the second magnetic conduction block 240. In this embodiment, the first magnetic conduction block is bonded with the insulating support. Preferably, the first magnetic conduction block and the insulating support are bonded and connected by epoxy resin adhesive. In another embodiment, the insulating support 150 is provided with a plurality of clamping blocks 152 on the groove wall of the mounting groove 151. The side wall of the first magnetic conduction block 120 is provided with a plurality of clamping interfaces 121, each clamping block 152 is inserted into a clamping interface 121. The first magnetic conduction block 120 is clamped with the insulating support 150. The first magnetic conduction block 120 is clamped with the insulating support 150, which is convenient for the user to disassemble and install the first magnetic conduction block 120, reduces the maintenance difficulty of the pushing assembly 200, and improves the maintainability of the anti-short circuit structure for a high-capacity relay. In another embodiment, the first magnetic conduction block 120 is accommodated in the mounting groove 151, and the first magnetic conduction block 120 is riveted with the insulating support 150. In this way, the connection stability between the first magnetic conduction block 120 and the insulating support 150 is improved. In other embodiments, the first magnetic conduction block 120 is hot-melt connected with the insulating support 150. In this way, the connection strength between the first magnetic conduction block 120 and the insulating support 150 is improved. In this way, the first magnetic conduction block 120 is firmly fixed, which improves the structural rigidity of the anti-short circuit structure for a high-capacity relay and ensures the working stability of the anti-short circuit structure for a high-capacity relay.

In an embodiment, arc extinguishing windows 153 are arranged on both side walls of the insulating support 150. In this way, the side walls of the insulating support 150 are equivalent to the arc extinguishing grid. When the arc is generated, the arc is pulled into the arc extinguishing grid under the "Lorentz force" of the magnetic line of force, and a long arc is divided into several short arcs, so as to achieve the arc extinguishing effect. It should be noted that in this embodiment, the insulating support 150 is an insulating plastic frame with extremely high temperature resistance. In this way, the arc extinguishing performance of the anti-short circuit structure for a high-capacity relay is further improved.

Figure 16:
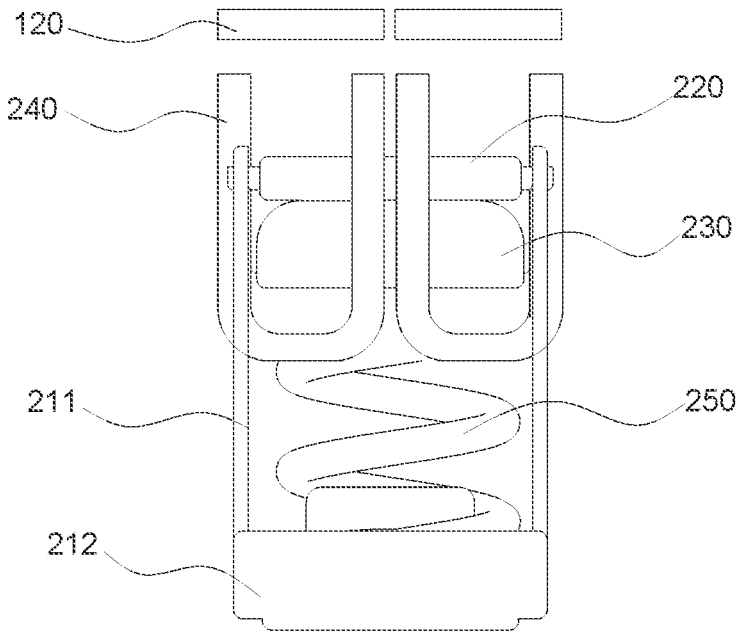
FIG. 16 is a structural diagram of part of the anti-short circuit structure for a high-capacity relay in one embodiment.

Referring to FIG. 16, in one embodiment, the movable contact spring 230 is a strip-shaped sheet structure which is provided with at least two second magnetic conduction blocks 240 and at least two first magnetic conduction blocks 120. Each of the second magnetic conduction blocks 240 is arranged in a line-shaped arrangement from one long side of the movable contact spring 230 to the other long side of the movable contact spring, each of the second magnetic conduction blocks 240 is arranged towards one of the first magnetic conduction blocks 120, each of the second magnetic conduction blocks 240 is used to form an independent magnetic flux with each of the first magnetic conduction blocks 120. In this embodiment, there are two first magnetic conduction blocks 120 with a strip-shaped sheet structure and two second magnetic conduction blocks with a U-shape. The two first magnetic conduction block 120 are arranged at intervals, and the two second magnetic conduction blocks 240 are arranged at intervals. That is, one side wall of one second magnetic conduction blocks 240 is adjacent to one side of another second magnetic conduction block 240, and the adjacent two side walls penetrate the middle area of the movable contact spring 230 and the stopping sheet 220. The two second magnetic conduction blocks 240 are butted with the elastic component 250. One side wall of each of the second magnetic conduction blocks 240 penetrates the fixed side arm 211 and is movably connected with the stopping sheet 220 and the two fixed side arms 211. The two second magnetic conduction blocks 240 respectively form two independent magnetic fluxes with the two first magnetic conduction blocks 120, that is, each second magnetic conduction block 240 forms one independent magnetic flux with one first magnetic conduction block 120. In this way, the magnetic attraction between the second magnetic conduction block 240 and the first magnetic conduction block 120 is realized.

Figure 17:
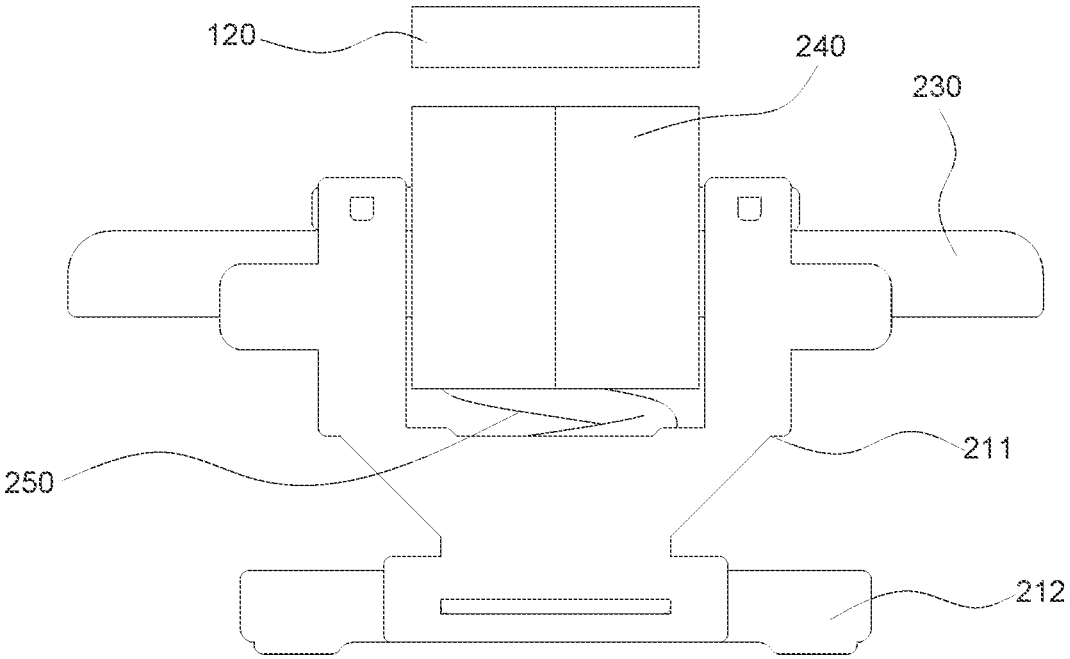
FIG. 17 is a structural diagram of another part of the anti-short circuit structure for a high-capacity relay in one embodiment.
Figure 18:
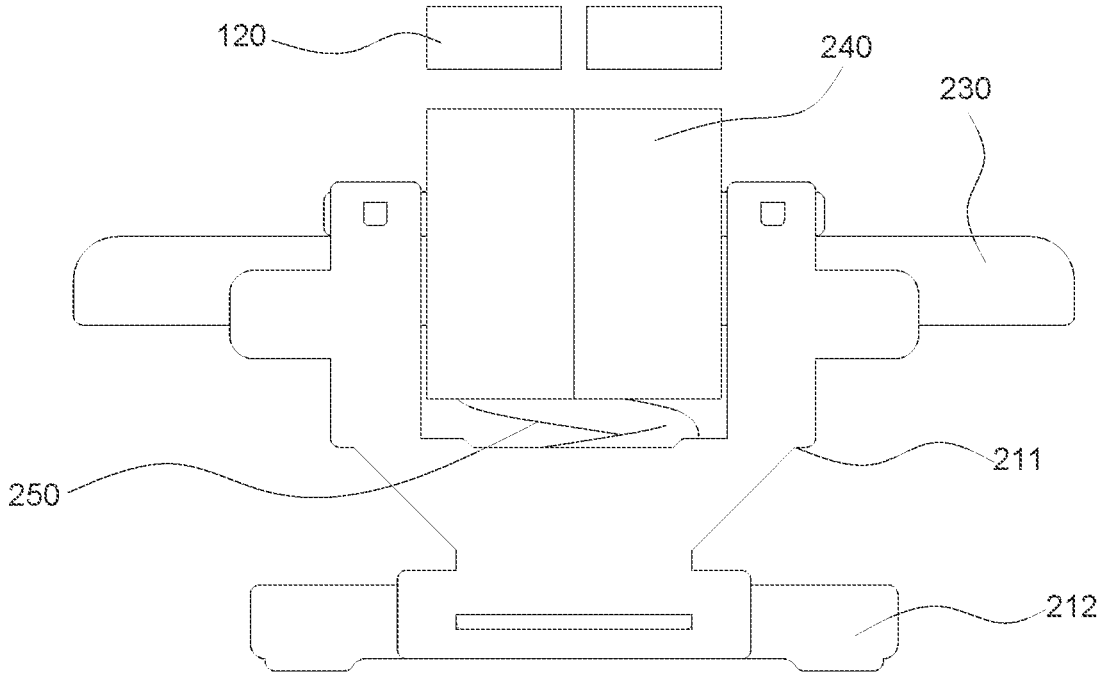
FIG. 18 is a structural diagram of another part of the anti-short circuit structure for a high-capacity relay in one embodiment.

Referring to FIG. 17, in one embodiment, movable contact spring 230 is a strip-shaped sheet structure which is provided with at least two second magnetic conduction blocks 240, each of the second magnetic conduction blocks 240 is arranged in a line-shaped arrangement from one short side of the movable contact spring 230 to the other short side of the movable contact spring, each of the second magnetic conduction blocks 240 is arranged towards the first magnetic conduction block 120, each of the second magnetic conduction blocks 240 is used to form an independent magnetic flux with the first magnetic conduction block 120. In this embodiment, the first magnetic conduction block 120 is a strip structure, and two second magnetic conduction blocks 240 with a U-shape are provided. The two side walls of each second magnetic conduction block 240 are wrapped around the two sides of the movable contact spring 230 and the stopping sheet 220. The end faces of the two ends of each second magnetic conduction block 240 are respectively arranged towards the two ends of the first magnetic conduction block 120. Both of the two second magnetic conduction blocks 240 are butted with the elastic component 250. The two side walls of each second magnetic conduction block 240 respectively penetrate the two fixed side arms 211, and the two side walls of each second magnetic conduction block 240 are movably connected with the stopping sheet 220 and the fixed side arm 211. The two second magnetic conduction blocks 240 are respectively form an independent magnetic flux with the first magnetic conduction block 120. In another embodiment, refer to FIG. 18, two first magnetic conduction blocks 120 with a strip structure are provided. Two second magnetic conduction blocks 240 with a U-shape are provided. Each second magnetic conduction block 240 forms an independent magnetic flux with one first magnetic conduction block 120. In this way, the magnetic attraction between each second magnetic conduction block 240 and the first magnetic conduction block 120 is realized.

In order to prolong the reverse electric life of the anti-short circuit structure for a high-capacity relay, in one embodiment, the stopping sheet 220 is provided with an arc isolating part (not shown in the figure), which is used to isolate the arc. In this embodiment, the arc isolating part is an insulating layer, and the insulating layer is wrapped on the outer surface of the middle area of the stopping sheet 220. In this embodiment, the insulating layer is a layer made of polytetrafluoroethylene. In another embodiment, the insulating layer is a layer made of high temperature nylon. Polytetrafluoroethylene (PTFE) and high temperature nylon are materials with excellent insulation properties. In addition, they also have the characteristics of chemical stability, cold resistance, fire resistance, aging resistance and corrosion resistance. The setting of the insulating layer has an insulating effect on the reverse arc, and the arc cannot be short circuited through the stopping sheet 220. In this way, the reverse arc short circuit is avoided, and the reverse electric life of the anti-short circuit structure for a high-capacity relay is further improved.

In order to facilitate the connection between the first magnetic conduction block 120 and the cover body 130, in one embodiment, the first magnetic conduction block 120 is bonded with the cover body 130. That is, the first magnetic conduction block 120 is connected to the top inner wall of the cover body 130 by an adhesive. In the embodiment, the adhesive is a one component or two-component resin. Preferably, the adhesive is epoxy resin adhesive. In this way, it is convenient for the user to realize the connection between the magnetic conduction block 120 and the cover body 130, and improves the connection strength between the magnetic conduction block 120 and the cover body 130.

The technical features of the above-mentioned embodiments can be arbitrarily combined. In order to make the description concise, all possible combinations of the technical features in the above-mentioned embodiments are not described. However, as long as there is no contradiction in the combination of these technical features, it should be considered as the scope of the description.

The above-mentioned embodiments only express several embodiments of the application, and the description is more specific and detailed, but it can not be understood as a limitation on the scope of the application. It should be pointed out that for ordinary technicians in the art, a number of modifications and improvements can be made without departing from the concept of the application, all these belong to the protection scope of the application. Therefore, the protection scope of the application shall be subject to the attached claims.

What is claimed is:

1. An anti-short circuit structure for a high-capacity relay, wherein, comprises a shell assembly and a pushing assembly;

the shell assembly comprises two fixed contacts, a first magnetic conduction block, a cover body, a transition block and a yoke plate; the two fixed contacts penetrate the cover body and are connected with the cover body, the first magnetic conduction block is arranged at an inner side surface of a top of the cover body, and the cover body is connected with the yoke plate through the transition block;

the pushing assembly comprises a fixing support, a stopping sheet, a movable contact spring, a second magnetic conduction block, an elastic component and a pushing rod; the fixing support comprises two fixed side arms and a bearing plate; the two fixed side arms are respectively arranged on both sides of the bearing plate; one end of the stopping sheet is connected with a tail end of one of the fixed side arms, and the other end of the stopping sheet is connected with a tail end of the other fixed side arm; the elastic component is arranged between the two fixed side arms, one end of the elastic component is connected with the bearing plate, and the other end of the elastic component is connected with the second magnetic conduction block; one side of the movable contact spring is connected with the second magnetic conduction block, and the other side of the movable contact spring is butted with the stopping sheet; one end of the pushing rod is connected with one side of the bearing plate facing away from the fixed side arm;

a receiving cavity for receiving the first magnetic conduction block, the fixing support, the stopping sheet, the movable contact spring, the second magnetic conduction block and the elastic component is jointly formed by the cover body, the transition block and the yoke plate; the pushing rod penetrates the yoke plate and is movably connected with the yoke plate;

two ends of the movable contact spring are respectively arranged towards the two fixed contacts, and the second magnetic conduction block is arranged towards the first magnetic conduction block; the first magnetic conduction block and the second magnetic conduction block are used for forming magnetic flux.

2. The anti-short circuit structure for a high-capacity relay according to claim 1, wherein, the first magnetic conduction block is a strip-shaped structure, the second magnetic conduction block is a U-shaped structure, side walls of the second magnetic conduction block are wrapped around two sides of the movable contact spring and the stopping sheet, end faces of two ends of the second magnetic conduction block are respectively arranged towards two ends of the first magnetic conduction block.

3. The anti-short circuit structure for a high-capacity relay according to claim 2, wherein, the shell assembly further comprises an insulating support which is an inverted U-shaped structure and is arranged in contact with an inner wall of the cover body, both of the two fixed contacts are penetrated through the insulating support, the insulating support is provided with a mounting groove, the first magnetic conduction block is accommodated in the mounting groove and connected with the insulating support.

4. The anti-short circuit structure for a high-capacity relay according to claim 3, wherein, the first magnetic conduction block is bonded with the insulating support.

5. The anti-short circuit structure for a high-capacity relay according to claim 3, wherein, two side walls of the insulating support are provided with arc extinguishing windows.

6. The anti-short circuit structure for a high-capacity relay according to claim 1, wherein, the second magnetic conduction block is a strip-shaped structure, the first magnetic conduction block is a U-shaped structure, end faces of two ends of the first magnetic conduction block are respectively arranged towards two ends of the second magnetic conduction block.

7. The anti-short circuit structure for a high-capacity relay according to claim 1, wherein, the movable contact spring is a strip-shaped sheet structure which is provided with at least two second magnetic conduction blocks and two first magnetic conduction blocks; each of the second magnetic conduction blocks is arranged in a line-shaped arrangement from one long side of the movable contact spring to the other long side of the movable contact spring, each of the second magnetic conduction blocks is arranged towards one of the first magnetic conduction blocks, each of the second magnetic conduction blocks is used to form an independent magnetic flux with each of the first magnetic conduction blocks.

8. The anti-short circuit structure for a high-capacity relay according to claim 1, wherein, the movable contact spring is a strip-shaped sheet structure which is provided with at least two second magnetic conduction blocks, each of the second magnetic conduction blocks is arranged in a line-shaped arrangement from one short side of the movable contact spring to the other short side of the movable contact spring, each of the second magnetic conduction blocks is arranged towards the first magnetic conduction block, each of the second magnetic conduction blocks is used to form an independent magnetic flux with the first magnetic conduction block.

9. The anti-short circuit structure for a high-capacity relay according to claim 1, wherein, the stopping sheet is provided with an arc isolating part configured for isolating arc.

10. The anti-short circuit structure for a high-capacity relay according to claim 1, wherein, the first magnetic conduction block is bonded with the cover body.

* * * * *